US005609205A

United States Patent [19]

Massie et al.

[11] Patent Number: 5,609,205

[45] Date of Patent: Mar. 11, 1997

[54] WELL FLUID SAMPLING TOOL

[76] Inventors: Keith J. Massie, 39 Beechgrove Terrace, Aberdeen; Jonathan W. Brown, 20 Richmond Terrace, Aberdeen AB2 4RL, both of Great Britain

[21] Appl. No.: 256,328

[22] PCT Filed: Jan. 7, 1993

[86] PCT No.: PCT/GB93/00016

§ 371 Date: Nov. 4, 1994

§ 102(e) Date: Nov. 4, 1994

[87] PCT Pub. No.: WO93/14295

PCT Pub. Date: Jul. 22, 1993

[30] Foreign Application Priority Data

Jan. 7, 1992 [GB] United Kingdom ..... 9200182

[51] Int. Cl.[6] ..... E21B 49/08

[52] U.S. Cl. ..... 166/163; 166/169; 166/264

[58] Field of Search ..... 166/264, 163, 166/169; 73/155

[56] References Cited

U.S. PATENT DOCUMENTS

| | | | |
|---|---|---|---|
| 3,095,930 | 7/1963 | Kisling, III | 166/163 |
| 4,291,585 | 9/1981 | Kolb et al. | 73/863.23 |
| 4,717,473 | 1/1988 | Burge et al. | 166/264 X |
| 5,058,674 | 10/1991 | Schultz et al. | 166/264 |

FOREIGN PATENT DOCUMENTS

| | | |
|---|---|---|
| 1423935 | 9/1988 | U.S.S.R. . |
| 91/12411 | 8/1991 | WIPO . |

*Primary Examiner*—Hoang C. Dang
*Attorney, Agent, or Firm*—Ratner & Prestia

[57] ABSTRACT

A well fluid sampling tool and method for retrieving chemically accurate hydrocarbon samples from new wells. The sampling tool is provided with a chemically inert sample chamber and lowered to the required depth in the well where a well fluid sample is admitted to the sample chamber, which is subsequently sealed. The tool is preferably arranged so that pressures inside and outside the sample chamber remain substantially equal during and after sample taking. The sample may be subject to post-sampling pressurisation to keep the sample in its original single-phase state.

The chemical inertness of the sample chamber avoids removal of reactive components of the well fluid from the sample by chemical reaction with the material of the sample chamber (which is conventionally metal). This enables accurate assessment of new wells without the need for extended flow testing. Equalisation of pressures inside and outside the sample chamber enables the material of the sample chamber to be selected for its chemical inertness rather than for mechanical strength to resist forces otherwise arising from pressure imbalances.

12 Claims, 4 Drawing Sheets

WELL FLUID SAMPLING TOOL

This invention relates to a well fluid sampling tool and to a well fluid sampling method.

Hydrocarbon fluids (oil and gas) are found in geological reservoirs wherein they are contained at a high pressure (relative to ambient atmospheric pressure), and usually also at an elevated temperature (relevant to ambient atmospheric temperature). At such pressures, the gas is dissolved in the oil such that the reservoir fluid initially exists as a single-phase fluid, but the reservoir fluid will release dissolved gas to form a two-phase fluid with separate gas and oil components if the reservoir fluid has its initial pressure sufficiently reduced towards ambient atmospheric pressure. Also, the initial relatively high temperature of the reservoir fluid results in volumetric contraction of a given mass of fluid as it cools toward ambient atmospheric temperature if withdrawn from the well.

When hydrocarbon exploration wells are drilled and hydrocarbon fluids are found, a well fluid test is usually performed. This test usually involves flowing the well fluid to surface, mutually separating the oil and the gas in a separator, separately measuring the oil and gas flow rates, and then flaring the products.

It is also desirable to take samples of the oil and gas for chemical and physical analysis. Such samples of reservoir fluid are collected as early as possible in the life of a reservoir, and are analyzed in specialist laboratories. The information which this provides is vital in the planning and development of hydrocarbon fields and for assessing their viability and monitoring their performance.

Reservoir fluids and gassee can have a complex composition and often include compounds such as hydrogen sulphide ($H_2S$), carbon dioxide and other trace elements including mercury which, when produced, can have a significant effect on process design, product sales and the environment.

During well testing of newly discovered reservoirs, it is essential that the oil company gains an accurate understanding of the fluid composition in order properly to evaluate the downstream potential of the reservoir. Flow periods are normally kept short during well testing because of the very high cost of the operation.

During a typical flow period of 18 to 24 hours, low levels of $H_2S$ may not be detected at a surface analytical station because of chemical reaction of the $H_2S$ with metallic tubing in the well completion between reservoir and surface, such that the $H_2S$ is effectively sequestered before it reaches the analytical station. (Such chemical reaction tending to conceal the presence of $H_2S$ in reservoir fluids will tend to be accelerated at the elevated temperatures and pressures commonly prevailing during well testing.) Current practice, when low $H_2S$ levels are detected, is to flow the well for an extended period (sometimes several days) until fluid component levels stahllisa at the surface analytical station. This extended flow testing is very costly and nevertheless there is still uncertainty about the true levels of $H_2S$ in the reservoir.

There are two ways of collecting reservoir samples:

1. Bottom Hole Sampling of the fluid directly from the reservoir, and
2. Surface Recombination Sampling of the fluid at the surface.

In Bottom Hole Sampling (BHS) a special sampling tool is run into the well to trap a sample of the reservoir fluid present in the well bore. Provided the well pressure at the sampling depth is above the "Bubble Point Pressure" of the reservoir fluid, all the gas will be dissolved in the oil, and the sample will be a single-phase fluid representative of the reservoir fluid, ie an aliquot.

Surface Recombination Sampling (SRS) involves collecting separate oil and gas samples from the surface production facility (eg from the gas/oil separator). These samples are recombined in the correct proportions at the analytical laboratory to Create a composite fluid which is intended to be representative of the reservoir fluid, ie a re-formed aliquot.

Several BHS tools are currently available commercially, which function by a common principle of operation.

A typical BHS tool is run into the well to trap a sample of reservoir fluid at the required depth by controlled opening of an internal chamber to admit reservoir fluid, followed by sealing of the sample-holding chamber after admission of a predetermined volume of fluid. The tool is then retrieved from the well and the sample is transferred from the tool to a sample bottle for shipment to the analytical laboratory. As the tool is retrieved from the well, its temperature drops and the fluid sample shrinks causing the sample pressure to drop. This pressure drop occurs because the sample-holding chamber within the typical BHS tool has a fixed volume after the sample is trapped. Usually the sample pressure falls below the Bubble Point Pressure, allowing gas to break out of solution. This means the sample is now in two phases, a liquid phase and a gas phase, instead of in single-phase form as it was before the pressure dropped. In order successfully to transfer the sample from the tool to the sample bottle, it is necessary to re-pressurise the sample sufficiently to force the free gas back into solution, recreating a single-phase sample. This recombination is a lengthy procedure and thus expensive.

The phase changes which the sample experiences may also cause the precipitation of compounds previously dissolved in the well fluid, some of which cannot be re-dissolved by re-pressurisation. The absence of these compounds in the re-formed aliquot renders certain analyses meaningless.

A means by which a well fluid sample could be collected, retrieved and transferred in single-phase form, without a pressure-induced phase change, would mitigate these problems. Not only would time spent recombining a two-phase sample back to single phase be saved, but pressure-sensitive compounds would remain dissolved, allowing more accurate analyses to be performed on the sample. Moreover a device which, unlike existing bottomhole sampling tools, could retrieve a sample for analysis from the remervoir depth with virtually no change in the sample's chemical composition would be a very attractive option for oil companies, offering very substantial cost savings in accurately determining $H_2S$ and trace element levels without the expense of extended flow testing.

Investigation has established that there are virtually no materials which can directly substitute the alloy used in constructing the sample chamber of a conventional bottomhole sampling device. All of the materials selected as being most chemically inert were generally mechanically unsuitable because of low yield strength, low fracture strength, poor resistance to shear, etc. The solution to the problem of retrieving an inert sample then becomes a matter of designing a tool which fully protects a sample chamber constructed from one of these chemically very inert but mechanically weak materials.

It is therefore an object of the present invention to provide a well fluid sampling tool and a well fluid sampling method which enable a chemically inert sample chamber to be employed without the adverse consequences or the mechanical weakness of a chemically inert material utilised to construct the sample chamber. According to a first aspect of the present invention there is provided a well fluid sampling tool comprising a sample chamber for receiving and holding a sample of well fluid, characterlead in that at least fluid-contacting surfaces of said sample chamber are formed of an inert material which is chemically substantially non-reactive with well fluid.

Said well fluid sampling tool preferably comprises pressure equalisation means functioning in use of said tool substantially to equalise pressures inside and outside said sample chamber whereby substantially to relieve said sample chamber of mechanical stresses otherwise resulting from the holding of a pressurised well fluid sample therein.

Said well fluid sampling tool preferably has the sample chamber in the form of a variable-volume sample chamber, said tool further comprising pressurisation means for pressurising a well-fluid sample held within said variable-volume sample chamber to maintain said well-fluid sample in single-phase state.

Said pressure equalisation means and said pressurisation means may be structurally at least partly combined.

Said pressurisation means may comprise a reservoir of compressed gas, which gas is preferably nitrogen.

Said well fluid sampling tool preferably comprises valve means for controlling admission of well fluid into said sample chamber and for subsequently applying pressurisation thereto.

Said sample chamber is preferably provided with a variable volume by forming one end of said sample chamber as a first floating piston subjected, in use of the tool, on one side thereof to the pressure of sampled well fluid and on the other side thereof to the combined pressures of said pressurisation means and of said pressure equalisation means. Said sample chamber is preferably formed as a cylinder coaxJelly mounted within a cylindrical casing of said tool to provide an annulus surrounding and extending substantially the length of the exterior of said sample chamber, said annulus being coupled to receive the combined pressures of said pressurisation means. Said annulus is preferably longitudinally partitioned by a second floating piston subjected, in use of the tool, on one side thereof to the pressure of sampled well fluid and on the other side thereof to the combined pressures of said pressurisation means and of said pressure equalisation means, said valve means conjointly controlling admission of well fluid into said sample chamber and into one end of said annulus. Said other side of said second floating piston is preferably hydraulically coupled to said other side of said first floating piston by way of hydraulic flow throttling means functioning in use of said tool to tend to retard longitudinal movement of said second floating piston with respect to longitudinal movement of said first floating piston during admission of well fluid to said sample chamber.

Said inert material is preferably a material which is substantially non-reactive with hydrogen sulphide. Said inert material may be at least one material selected from the group comprising sapphire, ceramic, and glass.

According to a second aspect of the present invention there is provided a well fluid sampling tool characterised in that it comprises a cylindrical casing, a cylindrical tube of chemically inert material coaxially mounted within said casing to form an annular volume between said tube and said casing, a first floating piston partitioning said tube and slidably sealed to the bore of said tube, said first floating piston being initially located towards a first end of said tube, a second floating piston of annular form partitioning said annular volume and slidably sealed both to the exterior of said tube and to the bore of said casing, said second floating piston being initially located towards a first end of said annular volume adjacent said first end of said tube, a filling of hydraulic fluid in said tube and in said annular volume between respective ends of said pistons and mutually adjacent respect second ends of said tube and of said annular volume, an initially empty chamber selectively connectable to said second ends of said tube and of said annular volume, and valve means for controlling discharge of said hydraulic fluid into said chamber and for simultaneously controlling admission of well fluid to said first ends of said tube and of said annular volume on the ends of said floating pistons opposite the ends of said floating pistons contacting said hydraulic fluid whereby well fluid at least partially fills said tube and said annular volume from the respective first ends thereof while pressures inside and outside said tube are maintained substantially equal, said valve means ultimately sealing a sample of well fluid within said tube.

Said tool preferably comprises an elastic pressure source subsequently connectable by said valve means to apply a pressure to said sample of well fluid to tend to maintain said sample in an initial single-phase state thereof despite thermal shrinkage thereof.

According to a-third aspect of the present invention there is provided a well fluid sampling method, said method being characterised by comprising the steps of providing a well fluid sampling tool having a sample chamber of which at least well fluid contacting surfaces thereof are formed of a chemically inert material, lowering said tool down a well to a location where well fluid is to be sampled, admitting a sample of well fluid into said sample chamber and then sealing said sample chamber.

Said method preferably comprises the further step of maintaining pressures inside and outside said sample chamber substantially equal whereby to relieve said sample chamber of forces otherwise arising from pressure imbalances between the inside and the outside thereof.

Said method preferably further comprises the additional step of subsequently applying pressurisation to said sample sealed in said sample chamber in a manner tending to counteract thermal shrinkage of the sampled well fluid during cooling thereof while raising of the tool and the sample up the well, to maintain said sample in single-phase state.

Embodiments of the present invention will now be described by way of example, with reference to the accompanying drawings wherein:

FIG. 1–4 schematically depict, in longitudinal section, a preferred embodiment of well fluid sampling tool in accordance with the invention, in various successive stages of its utilisation.

The structure of the well fluid sampling tool 10 will now be described in detail. (Functioning of the tool 10 will be detailed subsequent to the following structural description).

Figure 1:
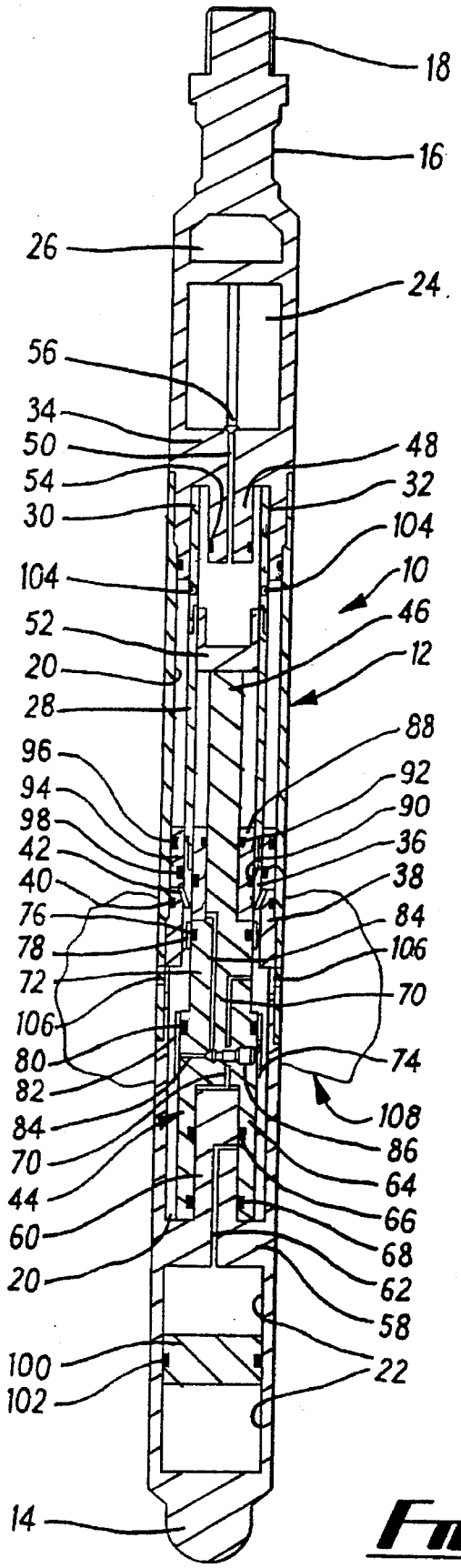
FIG. 1 depicts the preferred embodiment of well fluid sampling tool 10 in its 'ready for use' state as set-up and primed at the surface above a well (not depicted) ready for lowering down the well to take a sample of well fluid from a hydrocarbon reservoir existing at depth around and in fluid communication with the well.

Referring first to FIG. 1 (and cross-referencing to FIGS. 2–4 where noted), the tool 10 comprises an elongated cylindrical casing 12 formed at its lower end with a tapered nose 14. The upper end of the casing 12 is formed with a fishing neck 16 and a screw-threaded coupling half 18 by which the tool 10 may be attached to a wireline(not shown) or other suitable means for lowering and raising the tool 10 in a hydrocarbon well whose fluid is to be sampled.

The tool casing 12 is hollow and has various internal partitions which respectively define a first cylinder 20, a second cylinder 22, an air chamber 24, and a clock housing 26.

Coaxlally mounted within the first cylinder 20 is a cylindrical tube 28 of chemically inert material which may, for example, be sapphire, ceramic, or glass. (Alternatively, the tube 28 may be of a metal or alloy whose internal surface, and possibly also its external surface, is coated with a layer of chemically inert material which may be one of the afore-mentioned chemically inert materials). The tube 28 is mounted at its upper end by attachment to the lower end of a cylindrical sleeve 30 whose upper end is lodged in a cylindrical recess 32 formed in the lower face of a partition 34 dividing the first cylinder 20 from the air chamber 24 within the tool casing 12. The tube 28 is mounted at its lower end by an annular member 36 having a skirt 38 supported by the bore of the casing 12 and sealed thereto by a circumferential seal 40. The annular member 36 is formed with longitudinal ports 42 which hydraulically communicate the part of the cylinder 20 which is below the annular member 36 with the part of the cylinder 20 which is above the annular member 36 and outside the tube 28 (as may be seen in FIG. 2).

Figure 2:
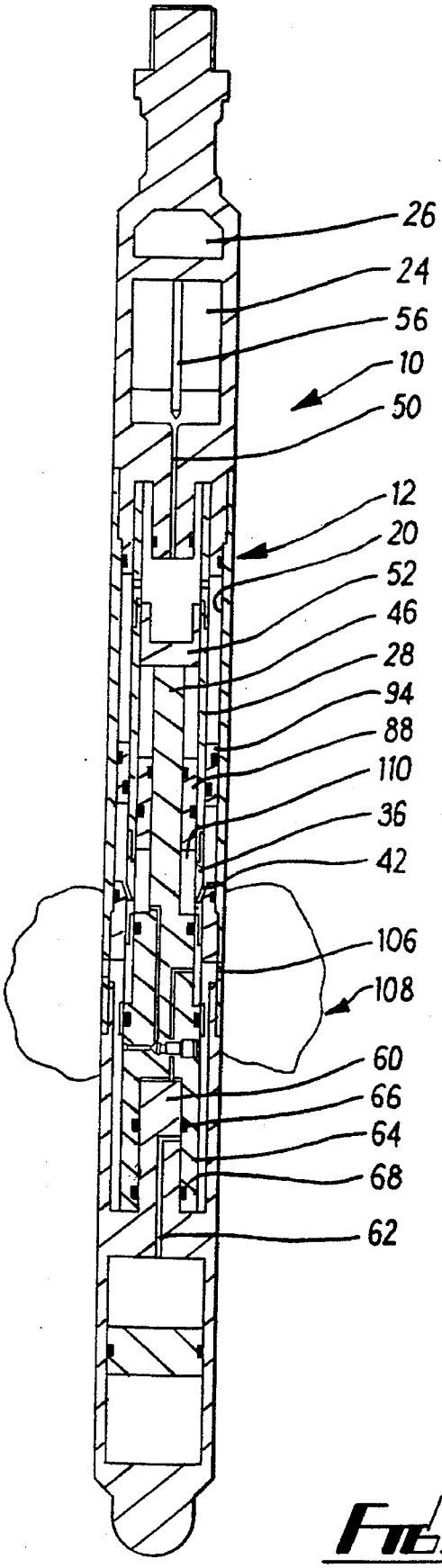
FIG. 2 depicts the tool 10 when lowered down the well to the depth of the hydrocarbon reservoir, and actuated to commence sampling well fluid, ie hydrocarbon fluid (normally oil containing dissolved gas(es) and other substances) which has passed from the reservoir into the well.
Figure 3:
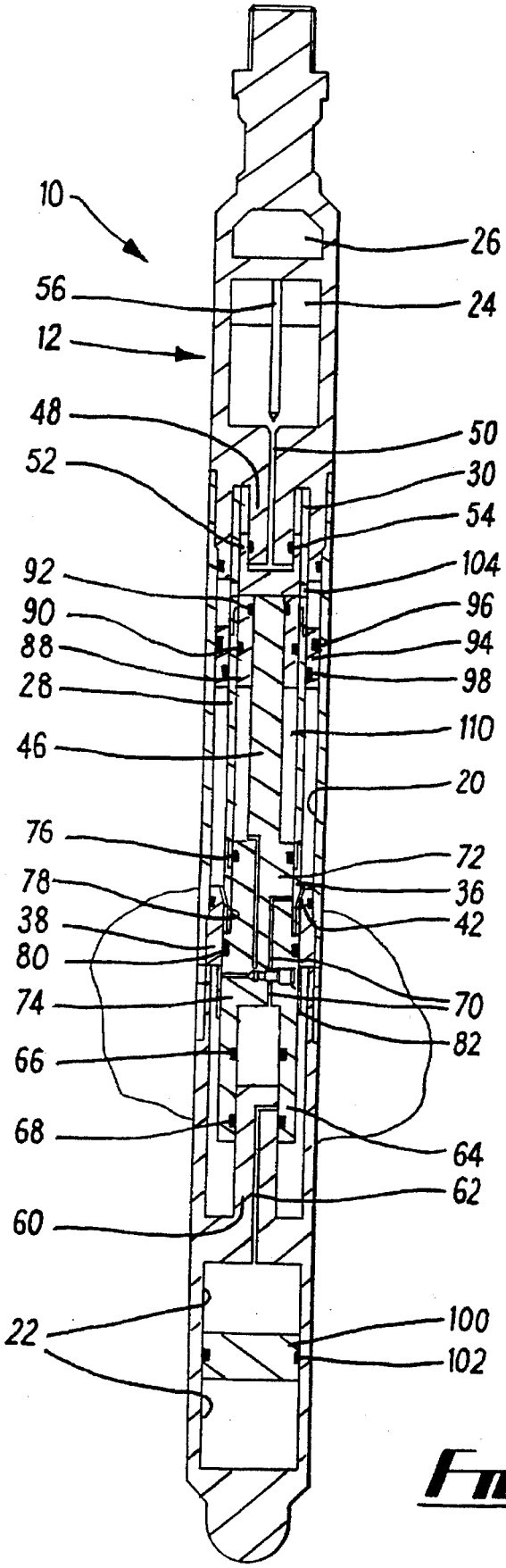
FIG. 3 depicts the tool 10 at the completion of sampling, and holding a sample of well fluid sealed within a sample chamber (detailed below).
Figure 4:
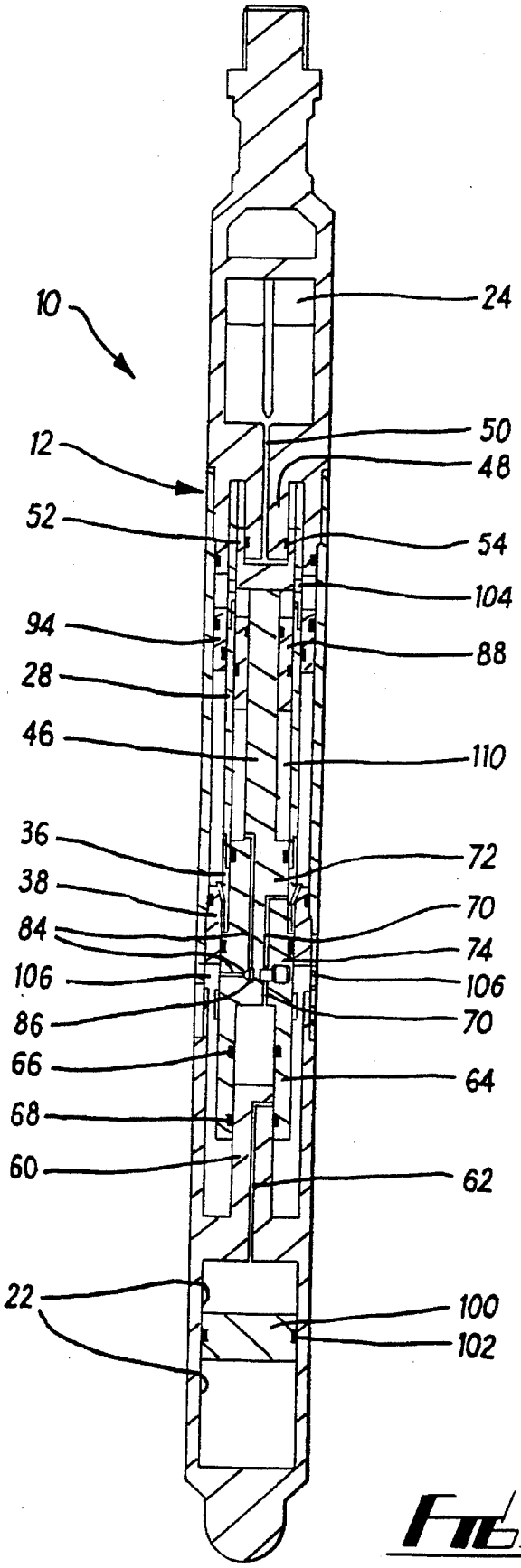
FIG. 4 depicts the tool 10 after the completion of sampling (FIG. 3) and still holding the sampled sealed within the sample chamber, but with a pressure compensation function in effect to maintain the sampled well fluid in a single-phase condition.

A shuttle valve member 44 is centrally mounted in the first cylinder 20 for longitudinal movement along the axis thereof between the first (lower) position shown in FIGS. 1 and 2, and the second (upper) position shown in FIGS. 3 and 4. The shuttle valve member 44 has a reduced diameter rod portion 46 where it passes through the tube 28, and the surface of this rod portion 46 is coated with a chemically inert material which may be one of the afore-mentioned chemically inert materials.

The partition 34 dividing the first cylinder 20 from the air chamber 24 is centrally formed with a depending cylindrical projection 48 (within the recess 32) having a longitudinal passage 50 linking the upper end of the first cylinder 20 with the air chamber 24. This projection 48 can be capped by a first cap member 52 secured on or integral with the upper end of the shuttle valve member 44 when the member 44 moves to its second (upper) position as shown in FIGS. 3 and 4, in which position the cylindrical hollow interior of the first cap member 52 cooperates with a circumferential seal 54 on the projection 48 to block the passage 50 to hydraulic flow therethrough.

In the primed or 'ready to use' configuration of the tool 10 as shown in FIG. 1 the upper end of the passage 50 is blocked by an obturator 56 under the control of a clock mechanism (not shown) mounted in the clock housing 26. At the commencement of sampling (FIG. 2), the obturator 56 is lifted by the clock mechanism to open the passage 50 to hydraulic flow therethrough, and the obturator 56 remains lifted thereafter during the remainder of the current cycle of operations of the tool 10. Subsequent closure of the passage 50 within the current cycle of operations of the tool to is caused by the above-described upward movement of the shuttle valve member 44 to its second (upper) position to bring the cap member 52 into sealing engagement around the projection 48 (FIGS. 3 and 4).

A partition 58 divides the first cylinder 20 from the second cylinder 22 within the tool casing 12. The partition 58 is centrally formed with an upwardly extending cylindrical projection 60 having a longitudinal and side-exiting passage 62 linking the upper end of the second cylinder 22 with the lower end of the first cylinder 20. This projection 60 is capped by a second cap member 64 integral with the lower end of the shuttle valve member 44 when the member 44 is in its first (lower) position as shown in FIGS. 1 and 2, in which position upper and lower annular seals 66 and 68 in the cylindrical bore of the second cap member 62 cooperate with the cylindrical exterior of the projection 58 to block the passage 62 to hydraulic flow therethrough. When the shuttle valve member 44 lifts to its second (upper) position as shown in FIGS. 3 and 4, the upper annular seal 66 rises above the upper end of the projection 60 and thereby effectively opens the passage 62 to hydraulic flow from the upper end of the second cylinder 22 to the interior of the second cap member 64. (Notwithstanding the apparent continued blockage of the side exit at the upper end of the passage 62 by the bore of the second cap member 64, the absence of a seal between the side exit and the top of the projection 60 permits hydraulic flow through the narrow gap between the bore of the second member 64 and the exterior of the projection 60 adequate to ensure the correct functioning of the tool 10, as will be subsequently be described in detail; this diagrammatic convention employed in the accompanying drawings wherein hydraulic flow is possible between relatively sizable components in the absence of a seal therebetween is of considerable significance in understanding the functioning of the tool 10, and may further be seen, for example, in hydraulic flow around the outside of the externally seal-free first cap member 52 (FIGS. 3 and 4), and additionally in other instances which will also be detailed subsequently).

A permanently open passage 70 extends between the upper end of the interior of the second cap member 64 and the exterior of the shuttle valve member 44 at a point thereon above the second cap member 64 and below the lower end of the reduced diameter rod portion 46 thereof.

The lower end of the shuttle valve member 44, below the lower end of the reduced diameter rod portion 46 and extending down to the upper end of the integral second cap member 64, has an upper cylindrical portion 72 and a lower cylindrical portion 74.

The upper cylindrical portion 72 has an external diameter substantially equal to the contiguous equi-diameter bores of the tube 28 and of its annular mounting member 36. The upper end of the cylindrical periphery of the upper cylindrical portion 72 is provided with a circumferential seal 76 retained in the FIGS. 1 and 2 configurations of the tool 10 by an axially slidable retainer ring 78. When the shuttle valve member 44 moves to its second (upper) position, contact between the ring 78 and the annular member 36 pushes the ring 78 down off the seal 76 to allow the seal 76 to seal the exterior of the upper cylindrical portion 72 to the bore of the annular member 36 and then to the bore of the tube 28 in succession as shown in FIGS. 3 and 4.

The upper end face of the upper cylindrical portion 72 is coated with a chemically inert material as a contiguous extension of the chemically inert coating on the reduced-diameter rod portion 46 of the shuttle valve member 44.

The above-mentioned passage 70 extending from the upper end of the interior of the second cap member 64 opens onto the periphery of the upper cylindrical portion 72 below the seal 76 but above the lower cylindrical portion 74.

The lower cylindrical portion 74 has an external diameter substantially equal to the bore of the skirt 38 of the annular member 36. The upper end of the lower cylindrical portion 74 is provided with a circumferential seal 80 retained in the FIGS. 1 and 2 configuration of the tool 10 by an axially slidable retainer ring 82. When the shuttle valve member 44 moves to its second (upper) position, contact between the ring 82 and the skirt 38 of the annular member 36 pushes the ring 82 down off the seal 80 to allow the seal 80 to seal the exterior of the lower cylindrical portion 74 to the bore of the skirt 38, as shown in FIGS. 3 and 4.

A sample recovery passage 84 communicates the exterior of the lower cylindrical portion 74 to the exterior of the lower end of the reduced-diameter rod portion 46 of the shuttle valve member 44. The passage a4 is normally closed during all cycles of well fluid sampling and retrieval (FIGS. 1–4) by means of a manually operable valve 85, the valve 86 being opened only during subsequent discharge of the well fluid sample for transfer or analysis, as subsequently described.

The annular volume within the tube 28 and around the reduced-diameter rod portion 46 of the shuttle valve member 44 is longitudinally divided by a first floating piston 88 which is externally slidingly sealed to the bore of the tube 28 by means of an external ring seal 90 and which is internally slidingly sealed to the exterior of the rod portion 46 by means of an internal ring seal 92. The lower end face of the first floating piston 88 is coated with a chemically inert material which may be one of the afore-mentioned chemically inert materials. Longitudinal movement of the first floating piston 88 is determined by the balance of pressures on opposite end faces thereof, is mechanically limited at the lower end of the range of movement of the piston 88 by abutment with the upper end of the upper cylindrical portion 72 of the shuttle valve member 44 (FIG. 1), and is mechanically limited at the upper end of the range of movement of the piston 88 by abutment with the lower end of the first cap member 52 secured to or integral with the upper end of the shuttle valve member 44 (FIG. 3).

The annular volume within the tool casing 12 and outside the tube 28 is longitudinally divided by a second floating piston 94 which is externally slidingly sealed to the bore of the tool casing 12 by means of an external ring seal 96 and which is internally slidingly sealed to the exterior of the tube 28 by means of an internal ring seal 98. Longitudinal movement of the second floating piston 94 is determined by the balance of pressures on opposite end faces thereof, is mechanically limited at the lower end of the range of movement of the piston 94 by abutment with the upper end of the skirt 38 of the tube 28 (FIG. 1), and is mechanically limited at the upper end of the range of movement of the piston 94 by abutment with the lower end of the partition 34 outside the cylindrical recess 32 therein.

The second cylinder 22 within the tool casing 12 is longitudinally divided by a third floating piston 100 which is slidingly sealed to the bore of the second cylinder 22 by means of a circumferential seal 102. A valve, which may be located In the casing 12 or in the tapered nose 14, by which the portion of the second cylinder 22 below the third floating piston 100 may be charged with high pressure nitrogen (or any other suitable gas or gas mixture) is not shown.

Permanently open ports 104 through the wall of the sleeve 30 provide continuous hydraulic communication from the upper end of the first cylinder 30 outside the tube 28 and the sleeve 30 (above the second floating piston 94) to the upper end of the first cylinder 20 inside the tube 28 and the sleeve 30 (above the first floating piston 88).

Permanently open side ports 106 through the wall of the tool casing 12 at locations immediately below the skirt 38 of the annular member 36 provide continuous passage for well fluid surrounding the tool 10 to enter the lower end of the first cylinder 20.

Having described the detailed structure of the well fluid sampling tool 10, details of its functioning will now be given.

Referring again to FIG. 1, this depicts the tool 10 as set up at the surface above a well whose fluid is to be sampled, and ready to be used to take and hold a sample of well fluid.

With the passage 50 closed by the obturator 56, the upper part of the first cylinder 20 is filled with a buffer fluid (eg a suitable hydraulic oil) which is pressurised to a predetermined pressure to drive the first and second floating pistons 88, 94, and the shuttle valve member 44 down to the positions shown in FIG. 1. (A valve means for the charging and pressurisation of this buffer fluid is not shown, and is thereafter closed during the cycle of operations of the tool 10).

The lower part of the second cylinder 22, ie the part below the third floating piston 100, is filled with high pressure nitrogen (or any other suitable gas or gas mixture) and then sealed. The gas pressure in the lower part of the cylinder 22 is then further boosted by pumping a pressure-transmitting fluid (eg a suitable hydraulic oil) into the upper part of the second cylinder 22, ie the part above the third floating piston 100, until the volume of the pressure-transmitting fluid is approximately equal to the volume of the further-pressurised nitrogen below the piston 100. The charge quantity of nitrogen is selected such that at the conclusion of pressurisation, the pressure of the pressure-transmitting fluid is equal to or greater then the expected bottom hole pressure, ie the expected pressure of the well fluid to be sampled. (A valve means for the charging and pressurisation of the pressure-transmitting fluid is not shown, and is thereafter closed during the current cycle of operations of the tool 10). The initial pressurisation of the nitrogen and of the pressure-transmitting fluid is retained until required (FIGS. 3 and 4) by the closure of the passage 62 by the seals 66 and 68 mounted within the second cap member 64, as shown in FIGS. 1 and 2.

The air chamber 24 is filled with relatively low pressure air (or with any other suitable gas or gas mixture), ie air at atmosphere or sub-atmospheric pressure. The air chamber 24 remains isolated for the time being from the upper end of the first cylinder 20 by the closure of the passage 50 by the clockcontrolled obturator 56.

Finally, the clock (not shown) within the clock housing 26 is set to lift the obturator 56 after a predetermined time delay sufficient to lower the tool 10 to sampling depth in the well (plus any selected safety margin to account for possible delays in deployment of the tool 10).

For the sake of completeness, FIG. 1 schematically depicts the tool 10 as lowered to sampling depth in the well, to be there adjacent the reservoir 108 whose fluid is to be sampled, such that well fluid from the reservoir 108 enters the side ports 106 in the tool casing 12 to flood the lower end of the first cylinder 20. (Despite this depiction in FIG. 1 of the entry of well fluid through the side ports 106, the configuration of the tool 10 as shown in FIG. 1 is nevertheless that of the tool 10 as set up at the surface above the well, since the side ports 106 are permanently open and thereby remain unaffected by any functional movement of the internal components of the tool 10).

Referring now to FIG. 2, this depicts the configuration of the tool 10 at the commencement of well fluid sampling.

The transition from the tool configuration of FIG. 1 to the tool configuration of FIG. 2 is initiated by the clock lifting the obturator 56 to open the passage 50 from the first cylinder 20 to the air chamber 24. The well fluid flooding the lower end of the first cylinder 20 transmits its considerable pressure to the lower end face of the first floating piston 88 (around the upper end of the upper cylindrical portion 72 of the shuttle valve member 44) and also to the lower end face of the second floating piston 94 (through the ports 42 extending between opposite end faces of the annular member 36). The pressure of the well fluid transmits through the floating pistons 88 and 94 to the Duffer fluid filling the upper end of the first cylinder 20 above these pistons 88 and 94. Since the passage 50 is now open by reason of the lifting of the obturator 56, and because the back pressure in the air chamber 24 is minimal or negligible in comparison to the pressure of the well fluid, buffer fluid is driven from the upper end of the first cylinder 20 through the passage 50 and into the air chamber 24 with concomitant upward movement of the floating pistons 88 and 94. (Previous inflow of well fluid and upward movement of the floating pistons 88 and 94 was prevented in the FIG. 1 configuration of the tool 10 by reason of the blockage to flow of the Duffer fluid above the pistons 88 and 94 by the obturator 56 sealing the passage 50). Flow of buffer fluid into the air chamber 24 is preferably restricted to prevent excessively rapid movements of the pistons 88 and 94, and to obviate mechanical and hydraulic shocks that might otherwise disrupt the tool 10 and its correct functioning. Such buffer fluid flow restriction may be accomplished by suitably restricting the cross-sectional dimensions of the passage 50, or by the provision of a flow restrictor (not shown). The rate of upward movement of the second floating piston 94 is regulated to be slower than the rate of upward movement of the first floating piston 88, conveniently by forming the ports 104 through the sleeve 30 with dime-alone sufficiently small as to provide restrictions to the flow of buffet fluid therethrough.

Of particular importance is the fact that during the above-described intake of well fluid, the pressures inside and outside the tube 28 are substantially equal such as to obviate any tendency for the tube 28 to burst inwards or outwards. This vital fact enables the material of the tube 28 to be selected for chemical inertness rather than for a mechanical strength adequate to withstand bursting pressures otherwise arising from lack of pressure equalisation.

As the first floating piston 88 travels upwards within the tube 28, it eventually comes into contact with the lower end of the first cap member 52 on the shuttle valve member 44, thereby to lift the shuttle valve member 44 and causing a transition to the tool configuration depicted in FIG. 3, to which reference will now be made.

With the lifting of the shuttle valve member 44 from its first (lower) position as shown in FIGS. 1 and 2 to its second (upper) position as shown in FIG. 3, four valve change-overs occur substantially simultaneously, as follows:

(1) The first cap member 52 at the upper end of the shuttle valve member 44 shrouds the projection 48 and cooperates with the circumferential seal 54 thereon to close and seal the passage 50 leading to the air chamber 24, so blocking further discharge of buffer fluid from the upper end of the first cylinder 20.

(2) The upper cylindrical portion 72 at the lower end of the shuttle valve member 44 enters, initially, the bore of the annular member 36 and then the contiguous bore of the tube 28 (with the seal retainer ring 78 being pushed downwards off the seal 76 by this bore entry) to bring the circumferential seal 76 into sealing contact with the bore of the tube 28. This action traps a well fluid sample 110 within the annular volume defined externally by the bore of the tube 28, internally by the reduced diameter rod portion 46 of the shuttle valve member 44, at the upper end by the lower end face of the first floating piston 88, and at the lower end by the upper end face of the upper cylindrical portion 72 at the lower end of the shuttle valve member 44. This annular volume constitutes the sample chamber of the well fluid sampling tool 10. Since the surfaces defining this annular volume or sample chamber holding the well fluid sample 110 are all formed of or coated with chemically inert material, the chemical integrity of the well fluid sample 110 is ensured by the absence of any metallic contact with the sample 110 that would otherwise lead to chemical reactions tending to sequester reactive camponents of the sample 110 (eg $H_2S$) and thereby disguise the existence of such redotire components in the well fluid being sampled.

(3) The lower cylindrical portion 74 at the lower end of the shuttle valve member 44 enters the bore of the skirt 38 of the annular member 36 (with the seal retainer ring 82 being pushed downwards off the seal 80 by this bore entry) to bring the circumferential seal so into sealing contact with the annular member 36. This action blocks the ports 42 through the annular member 36 and thereby traps such amount of well fluid as has entered the annular volume between the exterior of the tube 28 and the interior of the lower end of the first cylinder 20, between the lower face of the second floating piston 94 at its Upper end and the annular member 36 with its now-blocked ports 42 at the lower end. This trapped well fluid does not constitute a well fluid sample but does constitute hydraulic fluid which performs a significant pressure-transmitting function as will subsequently be detailed.

(4) The lifting of the second cap member 64 integral with the lowermost end of the shuttle valve member 44 raises the upper annular seal 65 within the second cap member 64 above the side exit of the passage 62, thereby allowing the pressure-transmitting fluid in the upper part of the second cylinder 22 to pass into the interior of the second cap member 64 and, by way of the passage 70, to pressurise the non-sample well fluid trapped within the above-described annular volume between the outside of the tube 28 and the interior of the lower end of the first cylinder 20, between the second floating piston 94 and the annular member 36. (As previously mentioned, the pressure-transmitting fluid passes from the upper end of the passage 70 to the trapped non-sample well fluid in the above-detailed annular volume by way of small but seal-free gaps between the relatively slidable components constituted in this case by the periphery of the upper cylindrical portion 72 and the bore of the annular member 36). At the same time, the lower annular seal 68 within the second cap member 64 remains in contact with the periphery of the projection 60 below the upper end of the passage 62, thus preventing leakage of pressure-transmitting fluid into the lower end of the first cylinder 20.

The pressure-transmitting fluid originating from the upper end of the second cylinder 22 is pressurised by the high pressure nitrogen charge in the lower end of the second cylinder 22, the pressure thereof being transmitted to the pressure-transmitting fluid through the third floating piston 100. The high pressure nitrogen charge constitutes an elastic pressure source (analogous to a powerful mechanical spring) which performs a desirable pressure compensation function tending to maintain the well fluid sample 110 in its original single-phase state despite subsequent temperature drops, as will now be detailed with reference to FIG. 4.

The tool configuration depicted in FIG. 4 follows on from the fool configuration depicted in FIG. 3, wherein the well fluid sample 110 was newly taken in and sealed off within a chemically inert sample chamber (defined in part by the interior of the tube 28). Subsequent to completion of this well fluid sampling process, the well fluid sampling tool 10 (holding the well fluid sample 110 sealed within the chemically inert sample chamber of the tool 10) will be raised to the surface above the well. Since the temperature of the reservoir will normally be significantly elevated above that of ambient temperature at the surface (and probably also above ambient temperatures in higher reaches of the well), the temperature of the well fluid sample 110 will tend to fall. Consequently there will be thermal shrinkage of the sample 110, and if the sample chamber were of constant volume, the internal pressure of the sample 110 is likely to fall below the pressure at which the sample retains its original single-phase state, leading to the initially discussed undesirable conditions which include a compromised physical and chemical integrity of the well fluid sample.

The tool configuration depicted in FIG. 4 shows a preferred aspect of the present invention, in which the well fluid sample 110 is kept sufficiently pressurised, despite its thermal shrinkage, as to maintain the sample 110 in its original single-phase state. This maintenance of sample pressurisation utilises the elastic pressure source constituted by the high pressure nitrogen charge in the lower end of the second cylinder 22, below the third floating piston 100. This nitrogen pressure transmits through the piston 100 and the pressure transmitting fluid in the upper part of the second cylinder 22 (above the piston 100) through the passages 62 and 70 to pressurise the non-sample well fluid trapped in the annular volume outside the tube 28, as previously described in detail. Pressurisation of the trapped fluid in the above-mentioned annular volume outside the tube 28 transmits through the second floating piston 94, the buffer fluid thereabove, the ports 104 in the sleeve 30, the contiguous buffer fluid above the first floating piston 88, and the piston 88 per se, to the well fluid sample 110 below the piston 88, Thus the elastic nitrogen pressure source directly influences the internal pressure of the well fluid sample 110, and by suitable selection of the initial pressurisation of the nitrogen (as previously detailed), the well fluid sample 110 will be reliably maintained in its initial single-phase state despite thermal shrinkage of the sample 110 (illustrated in FIG. 4 by the partial descent of the first floating piston 88 which defines the upper end of the chemically inert sample chamber within the tube 28; compare with FIG. 3).

However, by leading the pressure-transmitting hydraulic path from the nitrogen charge in the lower end of the second cylinder 23 around the outside of the tube 28, and taken across the top and finally down inside the upper end of the tube 38, substantial pressure equalisation between the outside and the inside of the tube 28 is maintained despite changes in the internal pressurisatlon of the tool 10 arising from the above-described pressure compensation for thermal shrinkage of the well fluid sample 110. Thus the physical integrity of the tube 28 is not compromised by these changing pressure conditions, and is maintained in equal measure to the beneficial effects arising from the previously described pressure equalisation prevailing during sample taking (FIG. 2).

After retrieval of the well fluid sampling tool 10 from the well, the contained well fluid sample 110 may be transferred directly to analytical apparatus (not shown) or to an intermediate sample transfer container (not shown) by coupling the analytical apparatus or transfer container through an aligned one of the side ports 106 in the tool caging 12 to the external end of the sample recovery passage 84 (on the periphery of the lower cylindrical portion 74), and then manipulating the valve 86 through another aligned one of the side ports 106 to open the valve 86 to allow discharge of the well fluid sample 110 from the sample chamber and transfer of the sample 110 through the now-open passage 84 to the analytical apparatus or transfer container. During such sample transfer, pressurisation of the well fluid sample 110 will be maintained by the high pressure nitrogen in the lower end of the second cylinder 22, augmented as necessary or desirable by further nitrogen charging and/or by pumping in extra pressure-transmitting fluid (at a suitable pressure) into a suitable point of the pressure-transmitting fluid circuit (eg the point at which the pressure-transmitting fluid was originally pumped in to give a further increase in nitrogen pressure, as described above with reference to FIG. 1).

Subsequent to transfer of the well fluid sample 110 from the well fluid sampling tool, remaining pressurisation within the tool 10 can be discharged and the various remanent fluids drained off, the tool 10 dismantled and cleaned (if necessary or desirable), then reassembled and recharged to the FIG. 1 configuration to be ready for a further well fluid sampling cycle of operations.

Handling and analysis of the discharged well fluid sample, preferably maintained at a pressure sufficient to maintain the sample in its initial single-phase state, can be undertaken by known or novel techniques (outside the scope of the present invention).

Although the above-described preferred embodiment provides pressure compensation for thermal shrinkage of the well fluid sample such, compensation can be omitted if desired. The present invention resides in the provision of a chemically inert sample chamber in a well fluid sampling tool. Preferably this is used in conjunction with the feature of substantial equalisation of pressures inside and outside the chemically inert sample chamber such as substantially to relieve the sample chamber of forces otherwise arising from pressure imbalances.

While a preferred embodiment of the present invention has been described above with reference to FIGS. 1–4, the invention is not restricted to the precise details described; modifications and variations can be adopted without departing from the scope of the invention as defined in the appended claims.

We claim:

1. A well fluid sampling tool comprising a sample chamber for receiving and holding a sample of well fluid, said tool being characterised in that at least fluid-contacting surfaces of said sample chamber are formed of an inert material which is chemically substantially non-reactive with well fluid, wherein said tool comprises pressure equalisation means functioning in use of said tool substantially to equalise pressures inside and outside said sample chamber whereby substantially to relieve said sample chamber of mechanical stresses otherwise resulting from the holding of a pressurised well fluid sample therein, and wherein said tool has the sample chamber in the form of a variable-volume sample chamber, and in that said tool further comprises pressurisation means for pressurising a well-fluid sample held within said variable-volume sample chamber to maintain said well-fluid sample in a single-phase state, and wherein said sample chamber is provided with a variable volume by forming one end of said sample chamber as a first floating piston subjected, in use of the tool, on one side thereof to the pressure of sampled well fluid and on the other side thereof to the pressure of said pressurisation means and to the pressure of said pressure equalisation means.

2. A well fluid sampling tool as claimed in claim 1, characterised in that said pressure equalisation means and said pressurisation means are structurally at least partly combined.

3. A well fluid sampling tool as claimed in claim 1, charscterised in that said pressurisation means comprises a reservoir of compressed gas.

4. A well fluid sampling tool as claimed in claim 3, characterised in that said gas is nitrogen.

5. A well fluid sampling tool as claimed in claim 1, characterised in that said tool comprises valve means for controlling admission of well fluid into said sample chamber and for subsequently applying pressurisation thereto.

6. A well fluid sampling tool as claimed in claim 5, characterised in that said sample chamber comprises a cylinder coaxially mounted within a cylindrical casing of said tool to provide an annulus surrounding and extending substantially the length of the exterior of said sample chamber, said annulus being coupled to receive the combined pressures of said pressure equalisation means and of said pressurisation means.

7. A well fluid sampling tool as claimed in claim 9, characterised in that said annulus is longitudinally partitioned by a second floating piston subjected, in use of the tool, on one side thereof to the pressure of sampled well fluid and on the other side thereof to the combined pressures of said pressurisation means and of said pressure equalisation means said valve means conjointly controlling admission of well fluid into said sample chamber and into one end of said annulus.

8. A well fluid sampling tool as claimed in claim 7, characterised in that said other side of said second floating piston is hydraulically coupled said other side of said first floating piston by way of hydraulic flow throttling means functioning in use of said tool to tend to retard longitudinal movement of said second floating piston with respect to longitudinal movement of said first floating piston during admission of well fluid to said sample chamber.

9. A well fluid sampling tool as claimed in claim 1 characterised in that said inert material is a material which is substantially non-reactive with hydrogen sulphide.

10. A well fluid sampling tool as claimed in claim 1, characterised in that said inert material is at least one material selected from the group comprising sapphire, ceramic, and glass.

11. A well fluid sampling tool characterised in that said tool comprises a cylindrical casing, a cylindrical tube of chemically inert material coaxially mounted within said casing to form an annular volume between said tube and said casing, a first floating piston partitioning said tube and slidably sealed to the bore of said tube, said first floating piston being initially located towards a first end of said tube, a second floating piston of annular form partitioning said annular volume and slidably sealed both to the exterior of said tube and to the bore of said casing, said second floating piston being initially located towards a first end of said annular volume adjacent said first end of said cube, a filling of hydraulic fluid in said tube and in said annular volume between respective ends of said pistons and mutually adjacent respective second ends of said tube and of said annular volume, an initially empty chamber selectively connectable to said second ends of said tube and of said annular volume, and valve means for controlling discharge of said hydraulic fluid into said chamber and for simultaneously controlling admission of well fluid to said first ends of said tube and of said annular volume on the ends of said floating pistons opposite the ends of said floating pistons contacting said hydraulic fluid whereby well fluid at least partially fills said tube and said annular volume from the respective first ends thereof while pressures inside and outside said tube are maintained substantially equal, said valve means ultimately sealing a sample of well fluid within said tube.

12. A well fluid sampling tool as claimed in claim 11, characterised in that said tool comprises an elastic pressure source subsequently connectable by said valve means to apply a pressure to said sample of well fluid to tend to maintain said sample in an initial single-phase state thereof despite thermal shrinkage thereof.

* * * * *